United States Patent [19]

Berry et al.

[11] Patent Number: 4,976,778

[45] Date of Patent: Dec. 11, 1990

[54] INFILTRATED POWDER METAL PART AND METHOD FOR MAKING SAME

[75] Inventors: David F. Berry, Westlake; Erhard Klar, Beachwood; Mark Svilar, Orange, all of Ohio

[73] Assignee: SCM Metal Products, Inc., Cleveland, Ohio

[21] Appl. No.: 210,579

[22] Filed: Jun. 23, 1988

Related U.S. Application Data

[63] Continuation-in-part of Ser. No. 165,587, Mar. 8, 1988, Pat. No. 4,861,373.

[51] Int. Cl.[5] ..... B22F 1/00

[52] U.S. Cl. ..... 75/254; 75/246; 411/10; 411/12; 411/27; 411/36; 419/37

[58] Field of Search ..... 419/12, 10, 27, 36, 419/37; 75/246, 254

[56] References Cited

U.S. PATENT DOCUMENTS

| | | | |
|---|---|---|---|
| 4,421,717 | 12/1983 | Vemulapalli | 419/36 |
| 4,554,218 | 11/1985 | Gardner et al. | 428/567 |
| 4,597,938 | 7/1986 | Matsuura et al. | 419/23 |
| 4,606,768 | 8/1986 | Svilar et al. | 75/246 |
| 4,710,223 | 12/1987 | Matejczyk | 75/248 |
| 4,731,118 | 3/1988 | Svilar et al. | 75/246 |
| 4,861,373 | 8/1989 | Klar et al. | 75/244 |
| 4,908,164 | 3/1990 | Brussino | 264/60 |

*Primary Examiner*—Stephen J. Lechert, Jr.
*Assistant Examiner*—N. Bhat
*Attorney, Agent, or Firm*—Lieberman Rudolph & Novak

[57] ABSTRACT

The present invention relates to an infiltrated ferrous powder metal part containing certain additives, yielding a part having improved dimensional control during infiltration and uniform and predictable distribution of dynamic properties within a given group of commonly manufactured parts.

6 Claims, No Drawings

INFILTRATED POWDER METAL PART AND METHOD FOR MAKING SAME

This application is a continuation in part of application Ser. No. 165,587 which was filed on Mar. 8, 1988, now U.S. Pat. No. 4,861,373.

BACKGROUND OF THE INVENTION

Ferrous powder metal (P/M) parts which are produced by conventional pressing and sintering processes, typically exhibit low impact and fatigue strength due to pores remaining in these parts after sintering. For many years however, these dynamic properties have been improved by infiltrating the sintered parts with copper or a copper based alloy, in an attempt to reach near full density. Although significant improvements in tensile and fatigue strength have been achieved, the improvement in impact strength has until recently been insufficient to permit use as high performance parts, which currently are thus made by more expensive powder forging and hot pressing methods.

Increased tensile and fatigue strengths have been achieved by heat treating an infiltrated part, however this typically results in reduced impact strength. Improvement in tensile and fatigue strength without loss of impact strength (toughness) and ductility would be an important advance toward the acceptance of infiltrated ferrous parts for high performance applications.

Prior to its commercialization in about 1946, copper infiltration of ferrous parts suffered from large positive dimensional changes taking place during infiltration. Of the growth-controlling additives known and used in the pressing and sintering of P/M parts, i.e., phosphorus, boron, carbon, lithium, silver, in the elemental or alloy form, carbon in the form of graphite came to be used exclusively for copper infiltration of ferrous parts. Carbon not only decreased the large positive dimensional changes down to manageable levels but also brought about desirable and clean reduction of oxides. It is for these reasons that today graphite additions corresponding to a combined carbon content (based on the iron content of the copper infiltrated part) from about 0.5% to about 0.8% are most commonly used in the industrial practice of copper infiltration of ferrous parts. At these levels of carbon, overall growth can be kept below about 0.7%.

There is, however, another phenomenon known as distortion that appears to be specific and peculiar to copper infiltrated parts. Distortion refers to the non-uniform, often erratic, dimensional changes taking place during infiltration, which cause dimensional tolerances of copper-infiltrated ferrous parts to be substantially inferior to those obtained by pressing and sintering. P/M parts made by pressing and sintering are often sized to improve dimensional tolerances. Infiltrated ferrous parts, however, do not respond very well to sizing because of their high strength and high density. Distortion is therefore an even more serious problem for copper infiltrated parts and a solution to this problem would enable a wider application of copper infiltration. This phenomenon is distinctly different from dimensional change. The dimensional change of a pressed and sintered part is typically symmetrical in directions parallel and perpendicular to the direction of pressing. In copper infiltration, however, this symmetry is lost and one therefore speaks of swelling and distortion. It appears that kinetic factors and topology and distribution of pores play an important role in this phenomenon. Copper infiltrated parts typically have dimensional tolerances inferior to parts made by pressing and sintering. As a result, the usefulness of such parts is restricted to applications requiring a lesser degree of dimensional accuracy, or, secondary machining may be necessary to improve the dimensional tolerances of infiltrated parts.

As described in U.S. Pat. Nos. 4,606,768 and 4,731,118 which are specifically incorporated by reference herein, the state-of-the-art of copper infiltration of P/M steels has advanced to a point where it is now possible to obtain copper infiltrated parts having Charpy un-notched impact strength and ultimate tensile strength of over 240 ft. lbs. and 96 ksi, respectively, or fatigue endurance limits of 65 ksi. These property values are dramatically superior to those obtained before.

It is not unusual, however, that these dynamic properties, for example impact strength, sometimes show differences of up to 100% within a batch of parts for a significant number of parts. The usefulness of these superior properties can therefore be exploited fully only to the extent that they can be uniformly and predictably distributed within a given batch of parts. This appears to be true regardless of whether the parts are made by the traditional infiltration technology giving impact strengths between about 10 and 20 ft. lbs. or by the advanced high performance infiltration technology giving impact strengths of between 120 to 240 ft. lbs. or more. The uniformity of properties appears to depend on a large number of both raw material and process related factors which are often difficult or impossible to predict in a given situation, this results in a higher incidence of parts which might not meet a desired specification and hence economic waste.

PRIOR ART

U.S. Pat. No. 4,483,905, to Engstrom, teaches that by adding a binding agent such as tall oil, polyethylene glycol, glycerin, or polyvinyl alcohol, to iron based powder mixes, the segregation of powder components can be reduced and a more uniform flow of the powder can be obtained. The loss of carbon due to dusting is also reduced.

In an article in *Metal Powder Report* (January 1987, pages 22 to 28) Engstrom describes improvements in the control of dimensional tolerances. However, these improvements relate to symmetric dimensional tolerances rather than the swelling and distortion discussed herein.

U.S. Pat. No. 4,504,441, describes the reduction of imperfections of sintered metal parts by reducing the segregation of powder components, particularly of components varying in their specific gravities, by the use of furfuryl alcohol and an acid.

The so called Distaloy powders, introduced by Hoeganaes Corporation some 20 years ago, achieve more uniform properties, particularly more uniform dimensional tolerances of the sintered parts, by the partial prealloying of some of the components of the powder blend. However, the improvement is attributed to the more uniform distribution of the components (L. E. Svensson and U. Engstrom in "Improved Precision of Sintered Components Made from Partially Prealloyed Copper Iron Powders", in *Powder Metallurgy*, 1979, No. 4, pages 165 to 174).

In a paper entitled "Properties of Parts Made From a Binder Treated 0.45% Phosphorous Containing Iron Powder Blend" (presented at the annual P/M Conference, Dallas, Texas, May 17–20, 1987) F. J. Semel attributes improved flow, reduced dusting, as well as improved uniformity of dimensions, hardness and crush strength to the improved distribution of phosphorous within the powder blend.

In all of the above cases however, the improvements of the dimensional tolerances relate to improvements of symmetric dimensional tolerances and not to the swelling and distortion of dimensions as found in copper infiltrated parts. In addition, the lack of uniformity in the distribution of dynamic properties and dimensional tolerances within a particular batch of parts, or between different batches of parts, is not treated by the prior art.

DISCLOSURE OF THE INVENTION

The invention resides principally in the discovery that adding certain additives, to a metal powder mix which is sintered and infiltrated with, for example, a copper or copper alloy infiltrant, yields a part with improved dynamic properties and dimensional tolerances which are more uniformly and predictably distributed within a given batch of parts thereby yielding more parts within a predictable tolerance range and reducing waste. Furthermore, the use of the additive, for example a polyvinyl binder, decreases distortion during infiltration.

The present invention although particularly described herein with reference to the infiltration of ferrous powder metal parts employing copper based materials as infiltrants, is not limited to such metals.

One embodiment of the instant invention consists of the use of binder containing metal powders in combination with copper infiltration of parts made from such metal powders. The resulting copper infiltrated parts are characterized in that they exhibit less distortion during infiltration. The reduced amount of distortion permits the production of net shaped high performance parts without post machining operations. The attainment of more uniform dynamic properties allows the use of parts at a higher strength level.

In order to better teach the instant invention to those skilled in the art, the following examples are provided:

EXAMPLE I

A powder blend consisting of about 0.9% graphite, about 0.75% Acrawac C, and the balance, A-1000 type iron powder from Hoeganaes Corporation, was used to make Izod specimens having a density of 7.0 grams per cubic centimeter. Special care is taken to assure uniform and even die fill.

Sintering was performed under vacuum with a cycle of about 30 minutes at about 1400oF and about 30 minutes at about 2050° F.

A copper infiltrant slug made from SCM Metal Products commercially available IP-204 copper infiltrant powder, weighing 14% of the impact specimen, was placed on top of the specimen and infiltration was accomplished under vacuum using the same cycle as described for the sintering treatment except that the length of time at about 2050° F. was about 7 minutes instead of about 30 minutes. After measuring the dimensions, the infiltrated specimens were then austenitized at about 1650° F. for about 30 minutes, oil quenched and tempered for about one hour at about 350oF under an inert atmosphere. The dimensions were measured again and the length of the Izod bars was then reduced to that of the standard Charpy bar (MPIF Standard 40). The specimens were then tested for impact strength.

EXAMPLE II

This example is identical to Example I including the use of identical blending equipment, etc., except for the use of a polyvinyl binder in the original powder blend. Such binder treated powder blends are available through Hoeganaes Corporation, Riverton, N.J. The standard deviations of the dimensions of the parts, after infiltration as well as after heat treatment were significantly smaller, that is the "scatter" for the distribution of dynamic properties for various parts within the batch was significantly reduced, when compared to the specimens of Example I. The impact strengths in the heat treated condition also fell within a significantly narrower "scatter" band than those of Example I.

Examples I and II demonstrate that the use of binder treated powders can yield parts exhibiting less distortion and having a more uniform and predictable distribution of dynamic properties, for example impact strength, among the parts of a specific batch or between batches.

EXAMPLE III

This example is identical to Example I with the exception that the copper infiltrant weighed only 11% of the impact specimen and both the sintering and the infiltration were accomplished in a single operation by placing the infiltrant on top of the green compact specimen and sintering under vacuum with a cycle of about 30 minutes at about 1400° F. and about 30minutes at about 2050° F. This experiment simulated conventional infiltration with an infiltrated density of about 7.5 grams per cubic centimeter. Dimensions and properties were determined as in Example I.

EXAMPLE IV

This example is identical to Example III except that the iron powder mixture contained a polyvinyl alcohol binder as in Example II.

A comparison of the results of Examples III and IV shows that binder treated powders also produce less distortion and more uniform impact strength when infiltration is performed in a single process (sintration) and the infiltrated density is significantly lower than in Examples I and II.

EXAMPLE V

This example was identical to Example I except that about 0.05% of boron was added to the iron powder blend in the form of a −270 mesh ferro boron powder containing about 3.8% boron. The properties of the infiltrated parts were determined as in Example I.

EXAMPLE VI

This example was identical to Example V except that the iron powder blend was prepared with a polyvinyl alcohol binder as in Example II.

A comparison of the properties of Examples V and VI shows that binder treated powders also give less distortion and more uniform impact strength.

We claim:

1. A process not necessitating solvent extraction of binder for making an infiltrated ferrous powder metal part which comprises the steps of:

(a) mixing a metal powder with a binder to produce a binder-powder mix;

(b) pressing said binder-powder mix into a compact;

(c) sintering said compact; and (d) infiltrating said sintered compact.

2. A process of claim 1, wherein the binder is a polyvinyl alcohol binder.

3. A process of claim 1, wherein the metal powder contains boron.

4. A binder-powder mix useful for producing an infiltrated ferrous powder metal part not necessitating solvent extraction of binder, said mix comprising a ferrous metal powder and a binder.

5. A powder mix of claim 4, wherein the binder is a polyvinyl alcohol binder.

6. A powder mix of claim 4, wherein the ferrous metal powder contains boron.

* * * * *